US007649497B2

(12) United States Patent
Yamada et al.

(10) Patent No.: US 7,649,497 B2
(45) Date of Patent: Jan. 19, 2010

(54) ANTENNA DEVICE, MOBILE TERMINAL AND RFID TAG

(75) Inventors: Akiko Yamada, Yokohama (JP); Makoto Higaki, Yokohama (JP); Shuichi Sekine, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 524 days.

(21) Appl. No.: 11/451,487

(22) Filed: Jun. 13, 2006

(65) Prior Publication Data

US 2007/0008228 A1 Jan. 11, 2007

(30) Foreign Application Priority Data

Jul. 11, 2005 (JP) ..... 2005-201915

(51) Int. Cl.
*H01Q 1/38* (2006.01)
*H01Q 1/24* (2006.01)

(52) U.S. Cl. ..... 343/700 MS; 343/702; 343/846; 343/829

(58) Field of Classification Search ..... None
See application file for complete search history.

(56) References Cited

U.S. PATENT DOCUMENTS

| | | | | |
|---|---|---|---|---|
| 6,046,703 | A | 4/2000 | Wang et al. | |
| 6,147,652 | A | 11/2000 | Sekine | |
| 6,184,833 | B1 | 2/2001 | Tran | |
| 6,285,328 | B1 | 9/2001 | Masaki et al. | |
| 6,336,037 | B1 | 1/2002 | Sekine et al. | |
| 6,346,916 | B1 | 2/2002 | Odachi et al. | |
| 6,683,575 | B2 | 1/2004 | Sekine et al. | |
| 6,747,600 | B2 | 6/2004 | Wong et al. | |
| 6,779,733 | B2 | 8/2004 | Akita et al. | |
| 6,819,290 | B2 * | 11/2004 | Hani et al. | 343/700 MS |
| 6,870,506 | B2 * | 3/2005 | Chen et al. | 343/700 MS |
| 6,924,768 | B2 | 8/2005 | Wu et al. | |
| 6,985,114 | B2 * | 1/2006 | Egashira | 343/702 |
| 7,129,902 | B2 * | 10/2006 | Bancroft | 343/767 |
| 7,250,910 | B2 | 7/2007 | Yoshikawa et al. | |
| 7,425,924 | B2 * | 9/2008 | Chung et al. | 343/702 |
| 2003/0029921 | A1 * | 2/2003 | Akita et al. | 235/492 |
| 2004/0046697 | A1 | 3/2004 | Tai et al. | |
| 2004/0246179 | A1 | 12/2004 | Chen et al. | |
| 2006/0114159 | A1 * | 6/2006 | Yoshikawa et al. | 343/702 |

FOREIGN PATENT DOCUMENTS

| | | |
|---|---|---|
| CN | 1404445 A | 3/2003 |
| JP | 60-189112 | 12/1985 |

(Continued)

*Primary Examiner*—Trinh V Dinh
(74) *Attorney, Agent, or Firm*—Oblon, Spivak, McClelland, Maier & Neustadt, L.L.P.

(57) ABSTRACT

There is provided with an antenna device including: a first wire antenna element having a length about half a wavelength of a radio wave in use; a second wire antenna element which is in a same plane as the first wire antenna element and substantially perpendicular to the first wire antenna element, and which is connected to the first wire antenna element at one end; a third wire antenna element which is in the same plane as the first wire antenna element and substantially in parallel with the first wire antenna element, and which is connected to the second wire antenna element; and a feed point provided on the second wire antenna element.

7 Claims, 9 Drawing Sheets

FOREIGN PATENT DOCUMENTS

| | | |
|---|---|---|
| JP | 62-116002 | 5/1987 |
| JP | 3165653 | 3/2001 |
| JP | 2001-156543 | 6/2001 |
| JP | 2004-23369 | 1/2004 |
| JP | 2004-194218 | 7/2004 |
| JP | 2005-12841 | 1/2005 |
| WO | WO 2004/070879 A1 | 8/2004 |

* cited by examiner

ANTENNA DEVICE, MOBILE TERMINAL AND RFID TAG

CROSS-REFERENCE TO RELATED APPLICATIONS

This application is based upon and claims the benefit of priority from the prior Japanese Patent Applications No. 2005-201915 filed on Jul. 11, 2005, the entire contents of which are incorporated herein by reference.

BACKGROUND OF THE INVENTION

1. Field of the Invention

The present invention relates to an antenna device available for small communication devices, such as for example a wearable apparatus, a mobile telephone and PHS, which are used in the vicinity of a human body, to a mobile terminal equipped with the antenna device, and to an RFID tag.

2. Related Art

Conventionally, there is a problem that radiation characteristics of an antenna are degraded in the case where a lossy dielectric such as a human body is present in the vicinity of the antenna. In order to solve this problem, it is considered to reduce absorption of a radio wave by the human body using an antenna having unidirectional directivity in the direction opposite to the human body. As means effective to provide an antenna with the unidirectional directivity, there is a method of attaching a ground plane to the antenna. A dipole antenna fitted with the ground plane is a typical example of the method. However, in this constitution, the antenna itself becomes comparatively large, resulting in a problem that it is difficult to mount the antenna to a small terminal apparatus and the like.

Further, power is generally fed to a radio apparatus in an unbalanced state (for example by a coaxial feeder, a microstrip line and the like), but the dipole antenna is a balanced type element, and hence, a balance-unbalance converter (balun) is needed at a feed point. This causes the radio apparatus to be complicated and makes the miniaturization of the apparatus difficult.

SUMMARY OF THE INVENTION

According to an aspect of the present invention, there is provided with an antenna device comprising: a first wire antenna element having a length about half a wavelength of a radio wave in use; a second wire antenna element which is in a same plane as the first wire antenna element and substantially perpendicular to the first wire antenna element, and which is connected to the first wire antenna element at one end; a third wire antenna element which is in the same plane as the first wire antenna element and substantially in parallel with the first wire antenna element, and which is connected to the second wire antenna element; and a feed point provided on the second wire antenna element, wherein the length of the third wire antenna element is longer than the length of the first wire antenna element, and wherein a sum (a+c+h) of a length (a) of one side of the first wire antenna element seen from a first connection point of the first wire antenna element and the second wire antenna element, a length (c) of the one side of the third wire antenna element seen from a second connection point of the second wire antenna element and the third wire antenna element, and a length (h) of the second wire antenna element, is different from a sum (b+d+h) of a length (b) of the other side of the first wire antenna element seen from the first connection point, a length (d) of the other side of the third wire antenna element seen from the second connection point, and the length (h) of the second wire antenna element.

According to an aspect of the present invention, there is provided with a mobile terminal comprising: a definite ground plane; a radio frequency module on the definite ground plane; an antenna device in a vicinity of an end side of the definite ground plane, the antenna device including a first wire antenna element having a length about half a wavelength of a radio wave in use, a second wire antenna element which is in a same plane as the first wire antenna element and substantially perpendicular to the first wire antenna element, and which is connected to the first wire antenna element at one end, a third wire antenna element which is in the same plane as the first wire antenna element and substantially in parallel with the first wire antenna element, and which is connected to the second wire antenna element, and a feed point provided on the second wire antenna element, wherein the length of the third wire antenna element is longer than the length of the first wire antenna element, and wherein a sum (a+c+h) of a length (a) of one side of the first wire antenna element seen from a first connection point of the first wire antenna element and the second wire antenna element, a length (c) of the one side of the third wire antenna element seen from a second connection point of the second wire antenna element and the third wire antenna element, and a length (h) of the second wire antenna element, is different from a sum (b+d+h) of a length (b) of the other side of the first wire antenna element seen from the first connection point, a length (d) of the other side of the third wire antenna element seen from the second connection point, and the length (h) of the second wire antenna element; and a feeder line configured to feed power from the radio frequency module to the feed point of the antenna device, wherein the definite ground plane is substantially perpendicular to a plane in which the first, second, and third wire antenna elements exist.

According to an aspect of the present invention, there is provided with an RFID tag comprising: a first wire antenna element having a length about half a wavelength of a radio wave in use; a second wire antenna element which is in a same plane as the first wire antenna element and substantially perpendicular to the first wire antenna element, and which is connected to the first wire antenna element at one end; a third wire antenna element which is in the same plane as the first wire antenna element and substantially in parallel with the first wire antenna element; and an IC chip including a first port connected to the second wire antenna element, a second port connected to the third wire antenna element, a tag storage storing tag information, and a radio frequency circuit which performs a transmission processing for the tag information to generate a transmission signal with the length about half the wavelength of the radio wave in use and supplies the generated transmission signal for the first and second port, wherein the length of the third wire antenna element is longer than the length of the first wire antenna element, and wherein a sum (a+c+h) of a length (a) of one side of the first wire antenna element seen from a connection point of the first wire antenna element and the second wire antenna element, a length (c) of the one side of the third wire antenna element seen from the second port, and a length (h) of the second wire antenna element, is different from a sum (b+d+h) of a length (b) of the other side of the first wire antenna element seen from the connection point, a length (d) of the other side of the third wire antenna element seen from the second port, and the length (h) of the second wire antenna element.

DETAILED DESCRIPTION OF THE INVENTION

In the following, embodiments according to the present invention will be described with reference to the accompanying drawings.

Figure 1:
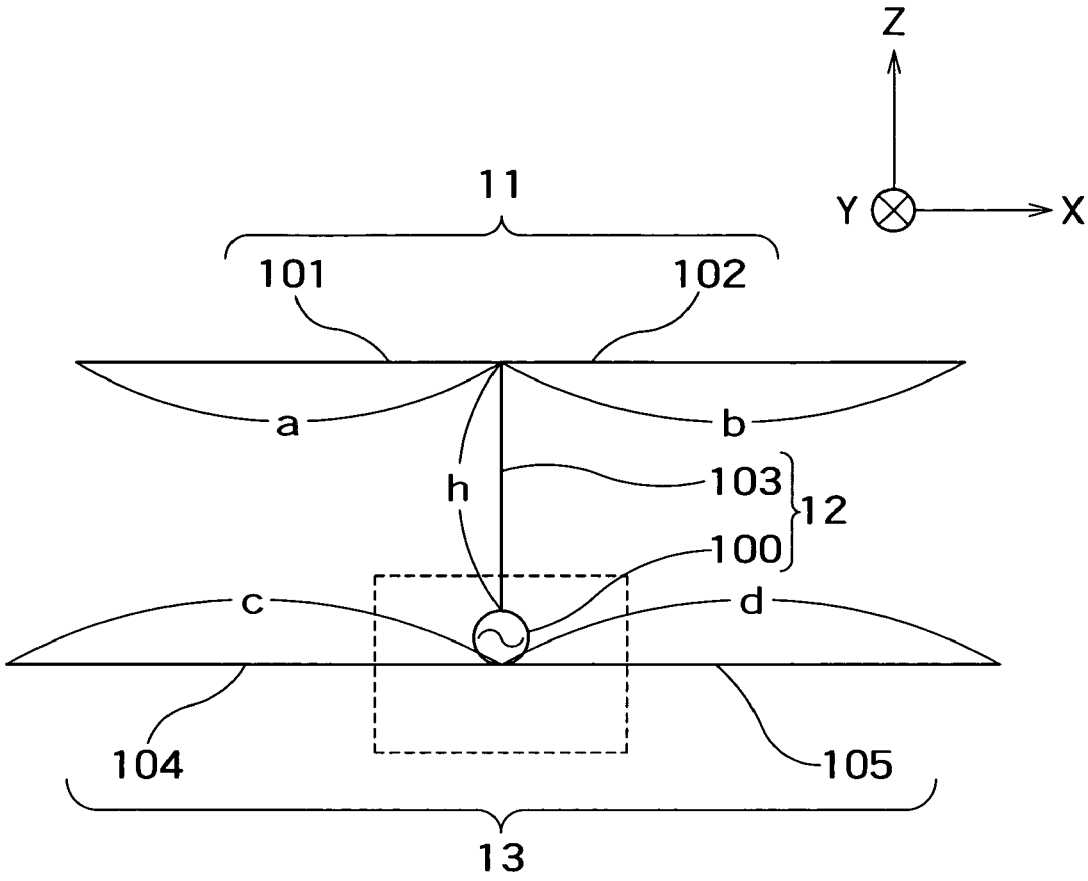
FIG. 1 is a figure showing an embodiment of an antenna device according to the present invention.

FIG. 1 shows an embodiment of an antenna device according to the present invention.

The antenna device has wire elements 101 to 105 made of a conductive material and a feed point 100. The wire elements 101 to 105 and the feed point 100 are positioned on a same plane. The wire elements are made of, for example copper.

The wire elements 101, 102 are connected in straight line form. A first wire antenna element 11 includes the wire elements 101, 102. One end of the wire element 103 perpendicular to the wire elements 101, 102 is connected to the connecting point of the wire elements 101, 102, and the other end of the wire element 103 is connected to the feed point 100. A second wire antenna element 12 includes the wire element 103, or includes the wire element 103 and the feed point 100. The wire elements 104, 105 are connected in straight line form. A third wire antenna element 13 includes the wire elements 104, 105. The wire elements 104, 105 are arranged in parallel with the wire elements 101, 102 (perpendicularly to the wire element 103), and a connecting point of the wire elements 104, 105 is connected to the feed point 100.

The antenna shown in FIG. 1, is characterized in that when the lengths of the wire elements 101, 102, 103, 104, 105 in the antenna are set to "a", "b", "h", "c", "d", respectively, a parallel resonance having a frequency between the frequencies of two series resonances is generated by making the lengths of two U-shaped elements (one of which is a set of the elements 101, 103, 104 and the other of which is a set of the elements 102, 103, 105), respectively, different from each other in order to obtain directivity in the z axis direction set as a desired direction (the upper direction in parallel with the plane of the paper). Further, the antenna is characterized by setting as (a sum of the lengths of the elements 101, 102)<(a sum of the lengths of the elements 104, 105) in order to operate the elements 101, 102 as a director.

Note that the wire elements 104, 105 may not be completely in parallel with the wire elements 101, 102, and that there may be a slight error in the parallelism within a range where the effect of the present embodiment can be obtained. Similarly, note that the wire elements 101, 102 may not be completely perpendicular to the wire element 103, and that there may be a slight error in the perpendicularity within a range where the effect of the present embodiment can be obtained.

The length "a" corresponds to one side of the first wire antenna element 11 seen from a connection point of the first wire antenna element 11 and the second wire antenna element 12. The length "b" corresponds to the other side of the first wire antenna element 11 seen from the connection point of the first wire antenna element 11 and the second wire antenna element 12. The length "c" corresponds to the one side of the third wire antenna element 13 seen from a connection point of the second wire antenna element 12 and the third wire antenna element 13. The length "d" corresponds to the other side of the third wire antenna element 13 seen from the connection point of the second wire antenna element 12 and the third wire antenna element 13.

Figure 2:
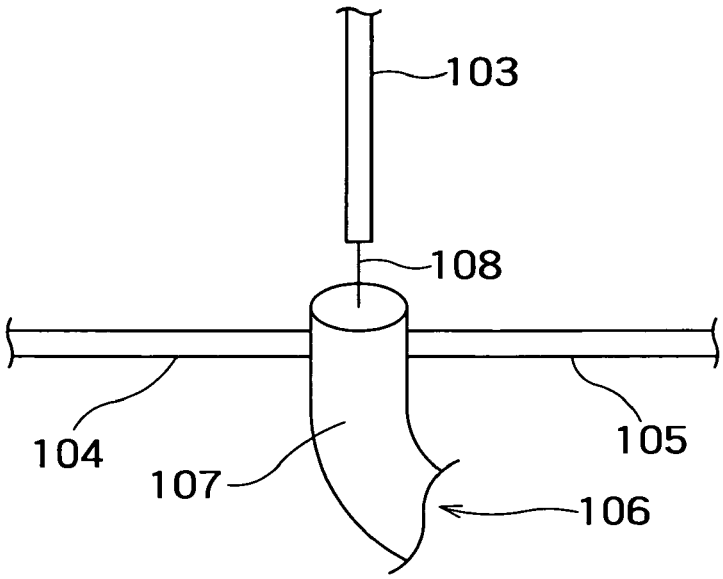
FIG. 2 is an enlarged view of a feeding section of the first embodiment.

FIG. 2 shows an enlarged view of the rectangular area indicated by the broken line in FIG. 1, and specifically, a detailed constitution of a feeding portion.

A coaxial feeder 106 is shown as a feeder line which feeds power to the feed point. The coaxial feeder 106 includes an inner conductor 108 and an outer conductor 107, and an insulator is interposed between the inner conductor 108 and the outer conductor 107. The inner conductor 108 stripped out from the coaxial feeder 106 is connected to the wire element 103, and the outer conductor 107 is connected to the wire elements 104, 105. An RF module is connected to the end of the coaxial feeder 106 opposite to the side of the wire element 103 (see FIG. 9 as will be described below). A high frequency signal is supplied between the inner conductor and the outer conductor of the coaxial feeder 106 from the RF module.

In the antenna device as described above, the wire element 11 is used as a radiation element, and the wire element 13 is used as a reflector element which reflects a radio wave radiated from the wire element 11. Such a constitution makes it possible for the proposed antenna to obtain unidirectional directivity and high efficiency in the vicinity of a lossy medium such as a human body. In the following, the reason why the unidirectional directivity can be obtained in the antenna according to the present embodiment will be described in detail.

Figure 3A:
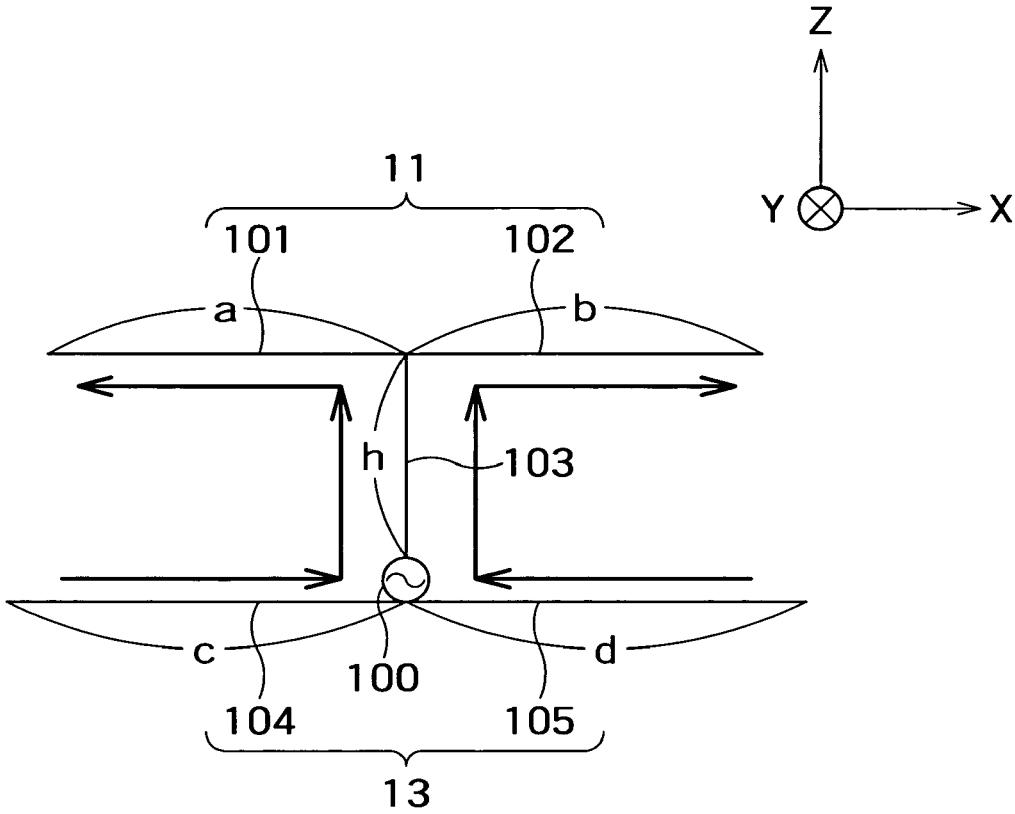
FIGS. 3A and 3B are figures explaining the current distribution on the antenna.

First, in the antenna device shown in FIG. 1, a case where the relationships between the wire elements 101, 102, 104, 105 are set as "a=b" and "c=d" is considered. At this time, the current distribution on the antenna is brought into a state as shown in FIG. 3A. The arrows in FIG. 3A show the direction of current. Such a state is referred to as a series resonance mode in an LC equivalent circuit, and the current becomes maximum at the feed point. The currents on the wire elements 101, 102 have phases opposite to each other, and the currents on the wire elements 104, 105 also have phases opposite to each other, as a result of which mutual cancellation of the currents is caused on the wire elements 101, 102, as well as on the wire elements 104, 105. Further, the currents flow in phase into the wire element 103 so as to intensify each other, thereby making the wire element 103 serve as a main radiation element. Therefore, a radiation pattern which is the same as in the case where a dipole antenna is placed on the z-axis, that is, a radiation pattern in the x axis direction is obtained, and hence, the directivity in the z axis direction as a desired direction cannot be obtained.

Figure 3B:
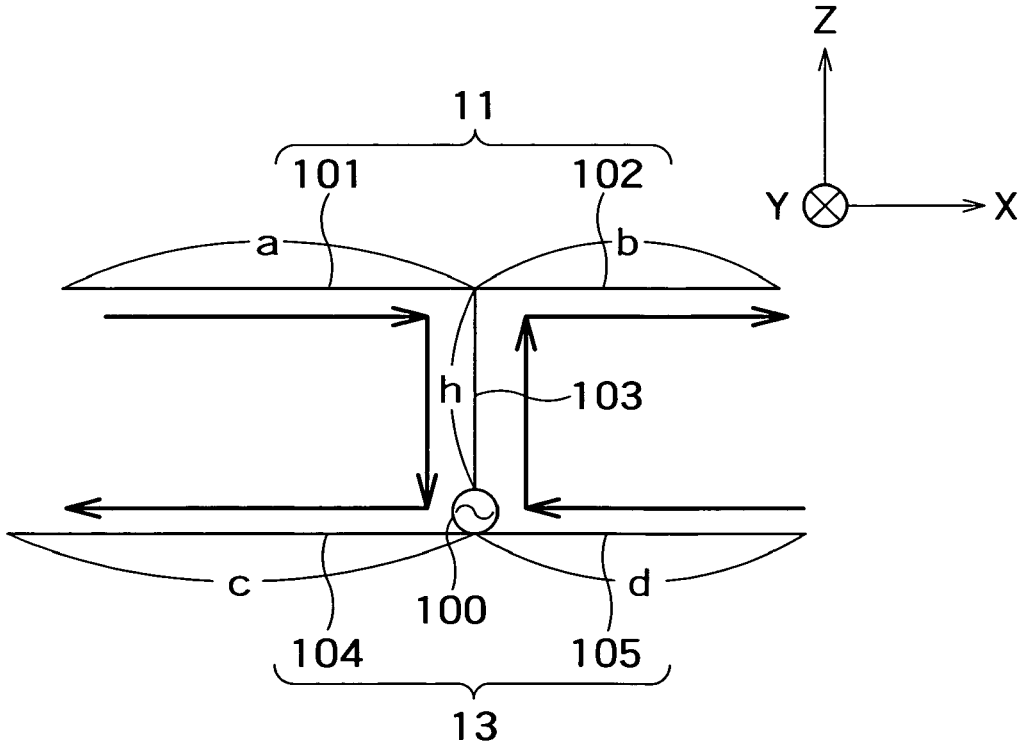

On the other hand, in the antenna device according to the present embodiment, a parallel resonance mode minimizing the current at the feed point is adopted in order to obtain the directional characteristic in the z axis direction as the desired directional characteristic. In the present embodiment, the length of "a+h+c" is set to be longer than the length of "b+h+d". With such setting, a resonance is generated by the wire elements 101, 103, 104, and a resonance is also generated by the wire elements 102, 103, 105 at a frequency higher than the frequency of the resonance generated by the wire element 101, 103, 104. These two resonances are series resonances. Between the frequencies of the two series resonances, a frequency of parallel resonance is necessarily generated. The current distribution at the time of parallel resonance mode is shown in FIG. 3B. At the time of the parallel resonance mode in which the current is minimized at the feed point, the currents flow in the direction as shown by the arrows in FIG. 3B and flow in opposite phase on the element 103. Thereby, mutual cancellation of the currents is caused on the element 103 so as to make the contribution of the element 103 to radiation small. On the other hand, the currents on the element 11 (the elements 101, 102) and the element 13 (the elements 104, 105) are in phase, as a result of which the radiation emitted by the elements 101, 102 and the elements 104, 105 becomes dominant. At this time, current distribution equivalent to a half wavelength dipole antenna is generated on the wire elements 11, 13 respectively, so that the radiation in the z axis direction is generated.

Further, in order to enable a radio wave to be emitted in the z axis positive direction, the length of wire element 13 needs to be designed to be longer than the length of the wire element 11. As a result of such designing, the radiation direction is inclined to the z axis positive direction when the phase of the current flowing on the wire element 11 is delayed from the phase of the current flowing on the wire element 13. On the contrary, the radiation direction is inclined to the z axis negative direction when the phase of the current flowing on the wire element 11 is advanced with respect to the phase of the current flowing on the wire element 13. The radio wave emitted in the z-axis negative direction is reflected by the wire elements 104, 105 to thereby be flown in the z-axis positive direction.

Figure 4:
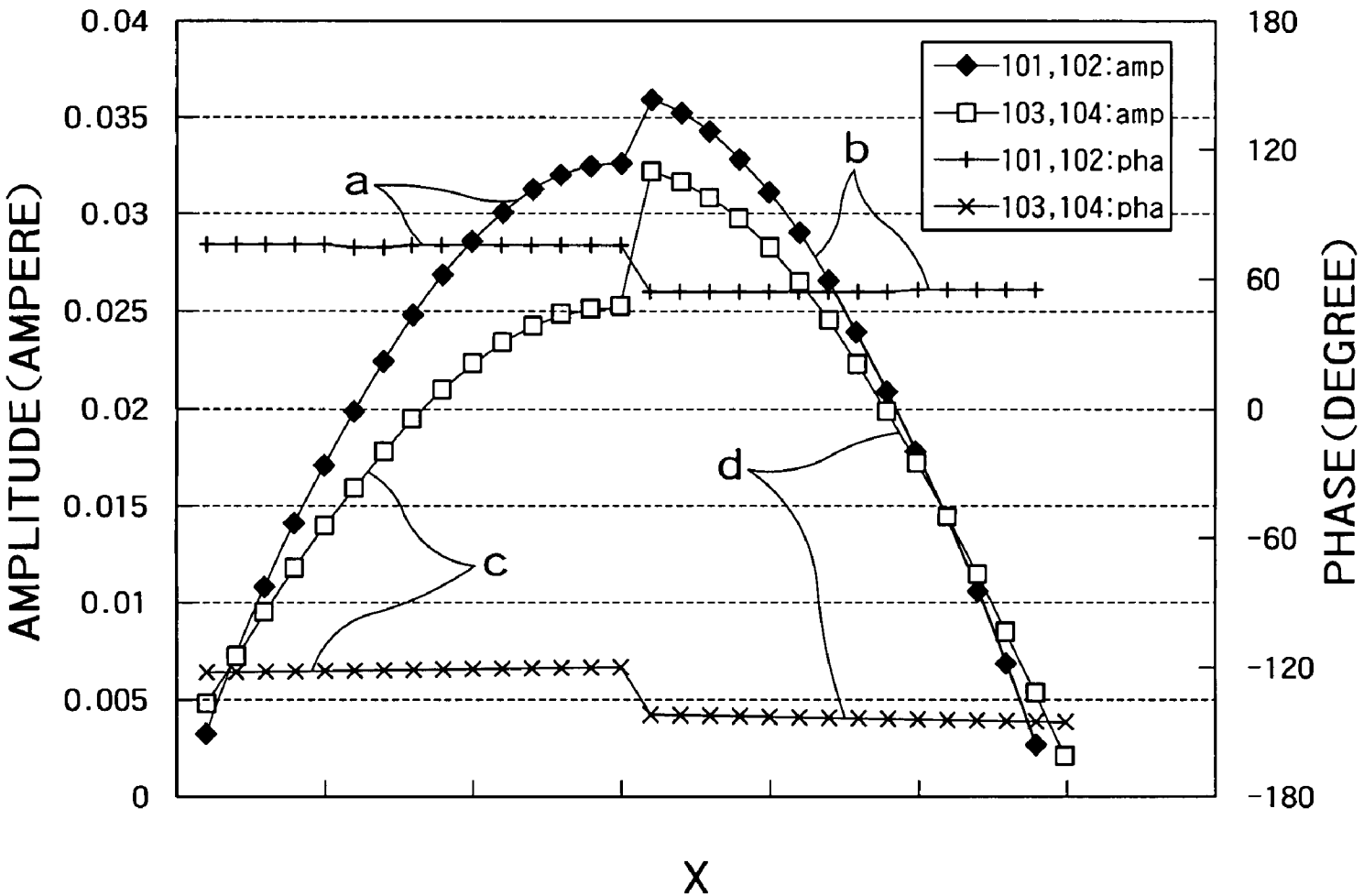
FIG. 4 is a graph showing the current distribution on the elements of the antenna.

There is shown in FIG. 4 the current distribution on the elements 101, 102, 104, 105 when the lengths of each of the wire elements are set as 101=30.6 mm, 102=27.9 mm, 103=5.0 mm, 104=32.5 mm, 105=29.9 mm, and at the time of the operating frequency=2450 MHz. In this graph, the vertical axis indicates the amplitude and phase of the current, and the horizontal axis indicates the position in the x axis (see FIG. 1). The current distribution on the elements 101, 102 is similar to that of the half wavelength dipole antenna. Further, the amplitude of the current on the element 103 is about ⅓ of the maximum value of the current on the elements 101, 102 (which is confirmed by a simulation result), as a result of which it is seen that the current of the elements 101, 102 is dominant in emitting radiation. Further, the phase of the elements 101, 102 is advanced by 180 degrees or more with respect to the phase of the current of the elements 104, 105, so that radiation is made to be easily emitted in the z axis positive direction, considering the distance "h".

Figure 5:
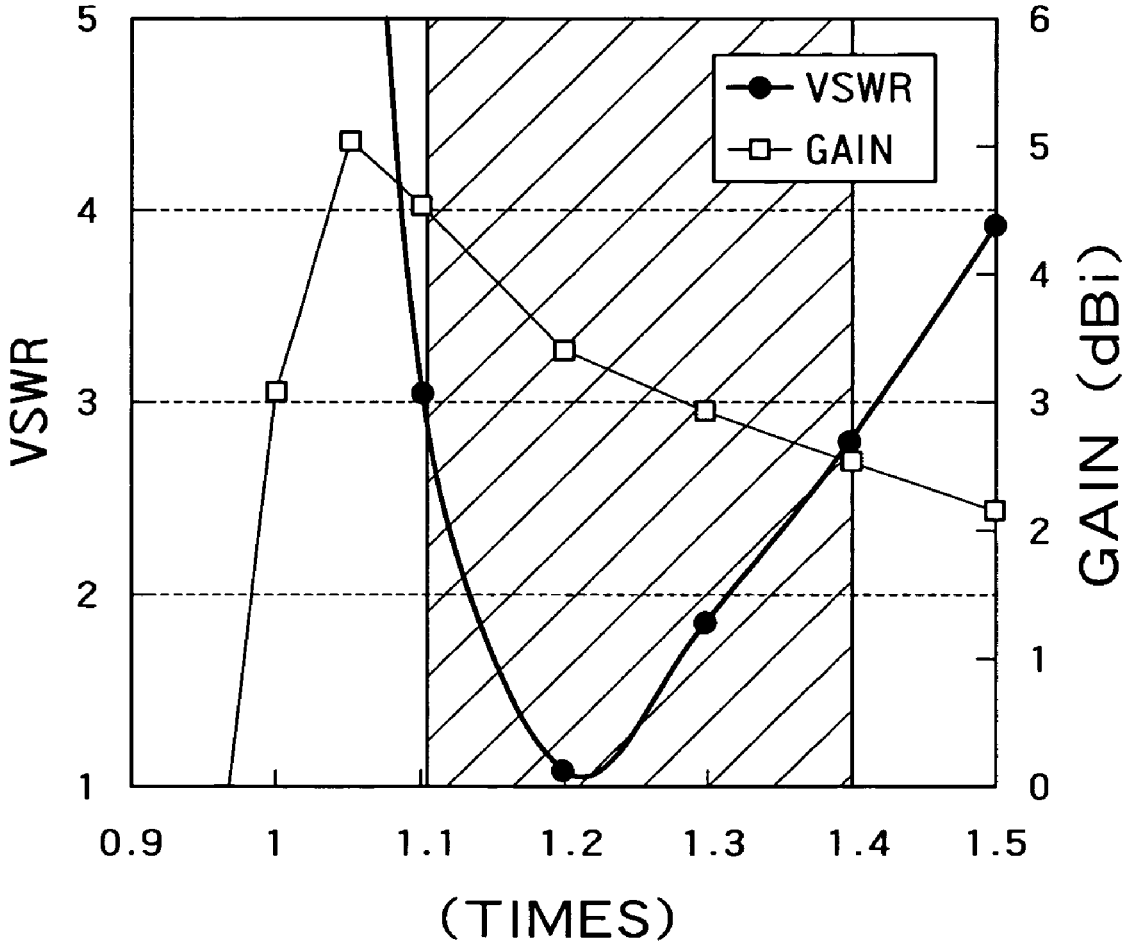
FIG. 5 is a figure showing a relationship between a ratio of the lengths of two wire element and a VSWR and a gain.

FIG. 5 is a graph explaining a suitable relationship between the length of the wire element 13 and the length of the wire element 11. This graph is obtained by a simulation performed by the present inventors.

It can be seen from FIG. 5 that when the ratio of the length of the wire element 13 to the length of the wire element 11 is within the hatched region, the VSWR and the gain become suitable values. That is, it is possible to obtain suitable values of the VSWR and the gain, when the ratio of the length of the wire element 13 to the length of the wire element 11 is in the range not smaller than 1.1 and not larger than 1.4 (i.e. the length is lager than or equal to 1.1 and smaller than or equal to 1.4).

Here, the VSWR (Voltage Standing Wave Ratio) is a degree of reflection wave generated at a connecting point of an antenna and a feeder line, and indicates a ratio of the maximum value to the minimum value of a standing wave generated due to the impedance mismatching. The smaller value of VSWR indicates a suitable state of fewer reflection waves.

Further, the gain of the antenna is obtained by comparing the amount of power fed or absorbed by the antenna with the amount fed or absorbed by a reference antenna which is separately defined. In the present example, the gain indicates an absolute gain (dBi) when a virtual isotropic antenna emitting radiation equally in all directions is selected as the reference antenna.

Here, it is shown that more effective characteristics can be obtained by further setting the lengths "a", "b" of the wire elements 101, 102 as will be described below, in addition to the relationships in the lengths of the wire elements 101 to 104 from which the desired resonance mode as explained above is obtained.

Figure 6:
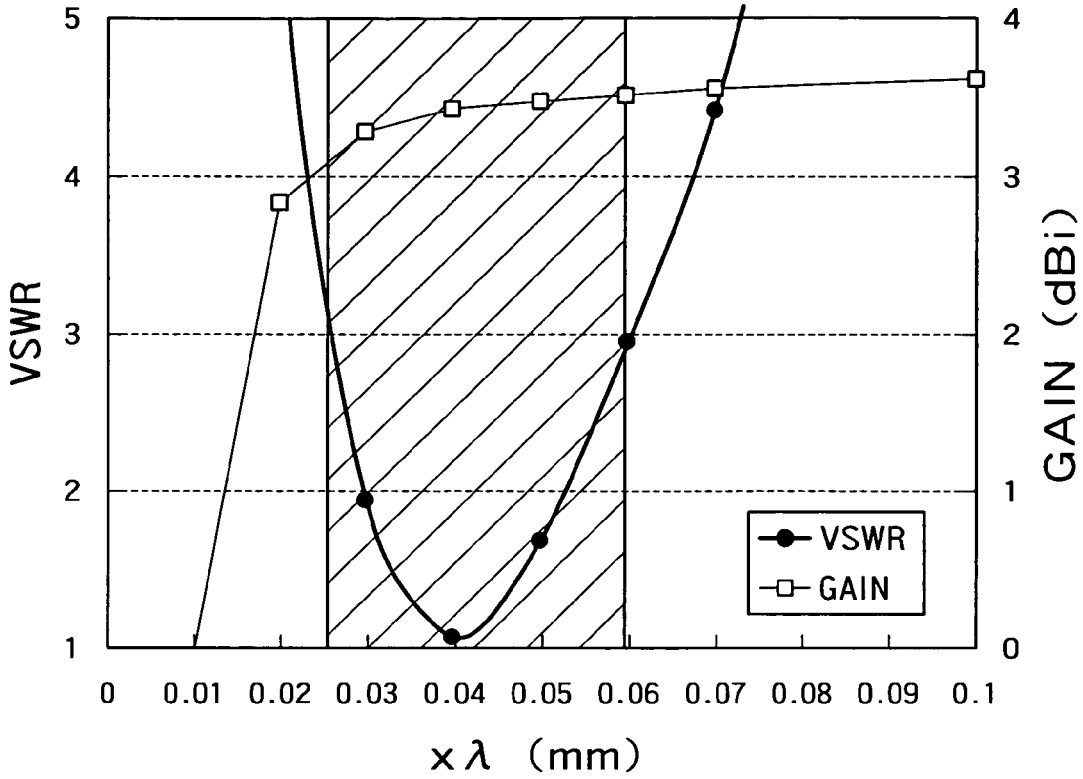
FIG. 6 is a figure showing a relationship between a difference in the lengths of the two wire element and a VSWR and a gain.

FIG. 6 is a graph showing relationships between the difference in the lengths of the wire element 101 and the wire element 102, and the VSWR and the gain. This graph is obtained by a simulation performed by the present inventors.

It can be seen from this graph that when the difference in the lengths of the two elements is 0.025λ to 0.06λ, a suitable VSWR and gain can be obtained. That is, when the offset from the center point of the wire antenna element which includes the wire element 101 and the wire element 102 is 0.013 (≅0.0125=0.025/2)λ to 0.03 (=0.06/2)λ, it is possible to obtain a suitable VSWR and gain. In other words, when the offset is larger than or equal to 0.013λ and smaller than or equal to 0.03λ, it is possible to obtain a suitable VSWR and gain.

Figure 7:
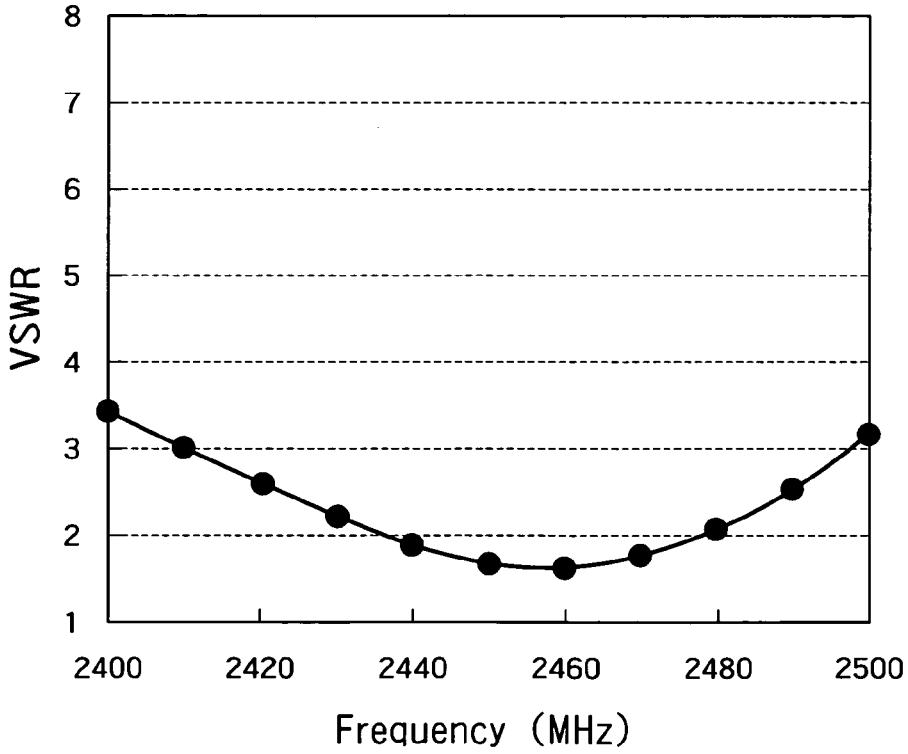
FIG. 7 is a figure showing a simulation result of the frequency characteristic of the VSWR.
Figure 8:
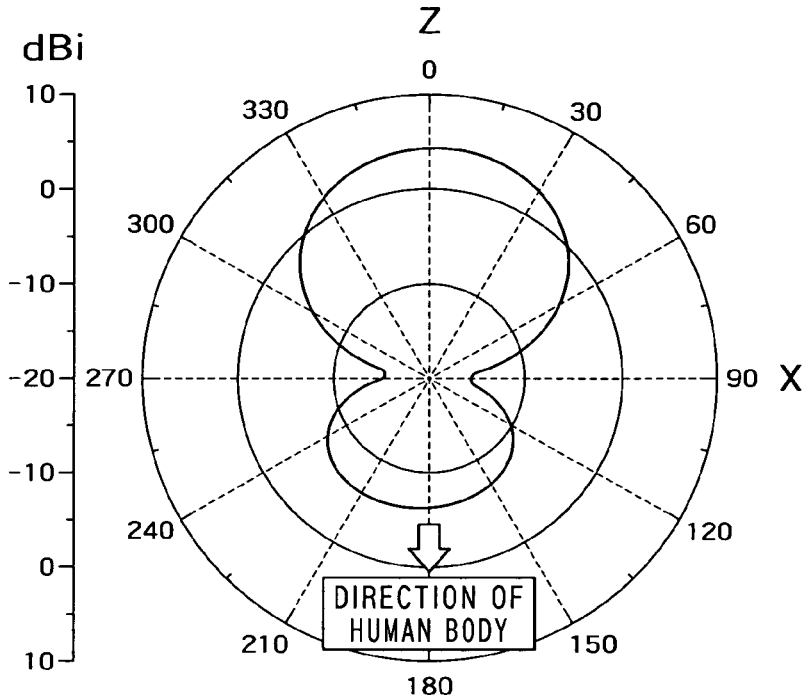
FIG. 8 is a figure showing a simulation result of the radiation pattern.

The simulation results of the antenna characteristic are shown in FIG. 7 and FIG. 8, when the length of each of the wire elements 101 to 105 is set as: 101=30.0 mm (0.25λ), 102=27.5 mm(0.23λ), 103=5.0 mm(0.04λ), 104=33.0 mm(0.27λ), 105=30.3 mm(0.25λ), based on the various conditions as described above. FIG. 7 shows a frequency characteristic of the VSWR, and FIG. 8 shows a radiation pattern in the z-x plane. It can be seen from the calculation result of the radiation pattern shown in FIG. 8, that the directivity is directed in the z axis positive direction, and that a desired unidirectional directivity is obtained. Here, the operating frequency is set as the operating frequency=2450 MHz, and the moment method is used for the simulation.

Figure 9:
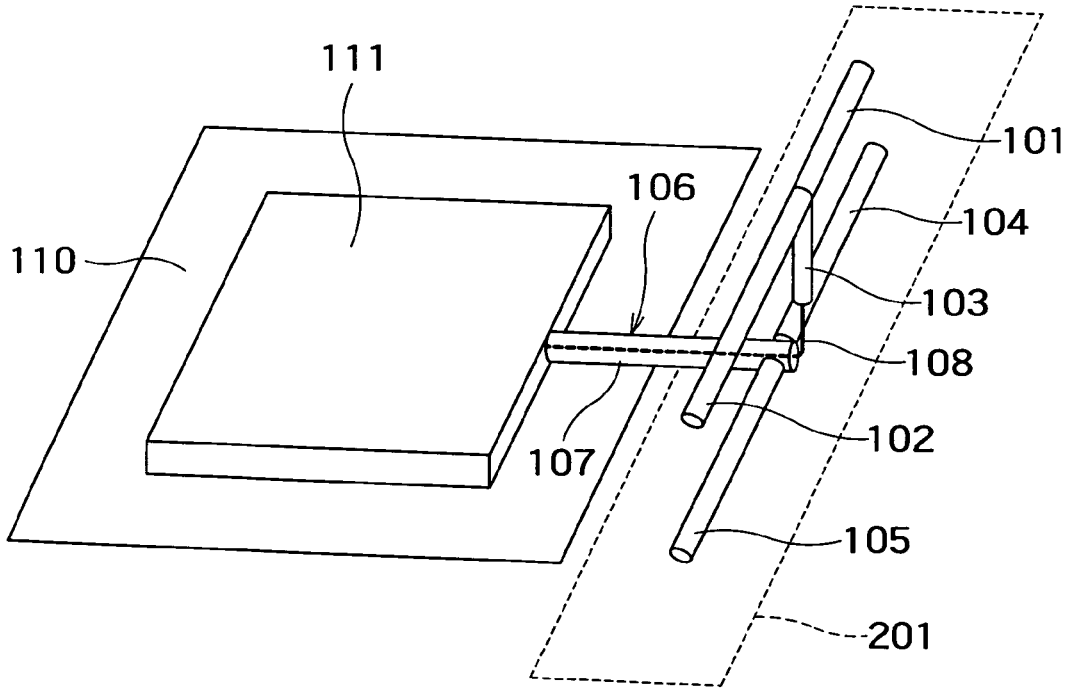
FIG. 9 is a figure showing a radio communication apparatus mounted with the antenna device shown in FIG. 1.

FIG. 9 is a perspective view schematically showing a radio communication apparatus mounted with the antenna device shown in FIG. 1.

The radio communication apparatus is provided with a substrate (definite ground plane) 110, an RF module 111, a coaxial feeder 106, and an antenna device 201.

The antenna device 201 has wire elements 101 to 105 and a feed point (see FIG. 1). The constitution of the antenna device 201 is fundamentally the same as that shown in FIG. 1 and FIG. 2. However, while in FIG. 2, the wire elements 104, 105 are physically integrated with each other, here, they are physically separated and connected with each other via the coaxial feeder 106. The present embodiment includes both the cases where the wire elements 104, 105 are physically integrated with each other, and where the wire elements 104, 105 are physically separated from each other. The same applies to the wire elements 101, 102.

The coaxial feeder 106 includes an outer conductor 107 and an inner conductor 108. The constitution of the coaxial feeder 106 is the same as that shown in FIG. 2, and therefore the detailed explanation of the coaxial feeder is omitted.

The substrate 110 has a ground surface plated with a metal. The RF module 111 is incorporated in a shield case, and is arranged on the surface of the substrate 110. The RF module 111 generates a high frequency signal, and supplies the generated high frequency signal to the feed point (see FIG. 1) of the antenna device 201 via the coaxial feeder 106.

The antenna device 201 is in the vicinity of an end side of the substrate 110, and one side of the substrate 110 is in parallel with the lengthwise direction of the antenna device 201. At this time, the substrate 110 and the wire elements 104, 105 are arranged to exist in a same plane, while a plane in which the wire elements 101, 102, 104, 105 exist is arranged to be perpendicular to the surface of the substrate 110. The antenna device 201 and the one side of the substrate 110 are preferably separated from each other at a distance of, for example, 1 mm (0.008λ) or more.

The current at the feed point is minimized in the proposed antenna device, so that the antenna device is not influenced by the substrate 110, even when it is connected to the substrate 110 via the feeder line. Thus, the antenna device can be arranged in a manner as shown in FIG. 10 to FIG. 13, so that a degree of freedom of designing can be improved.

Figure 10:
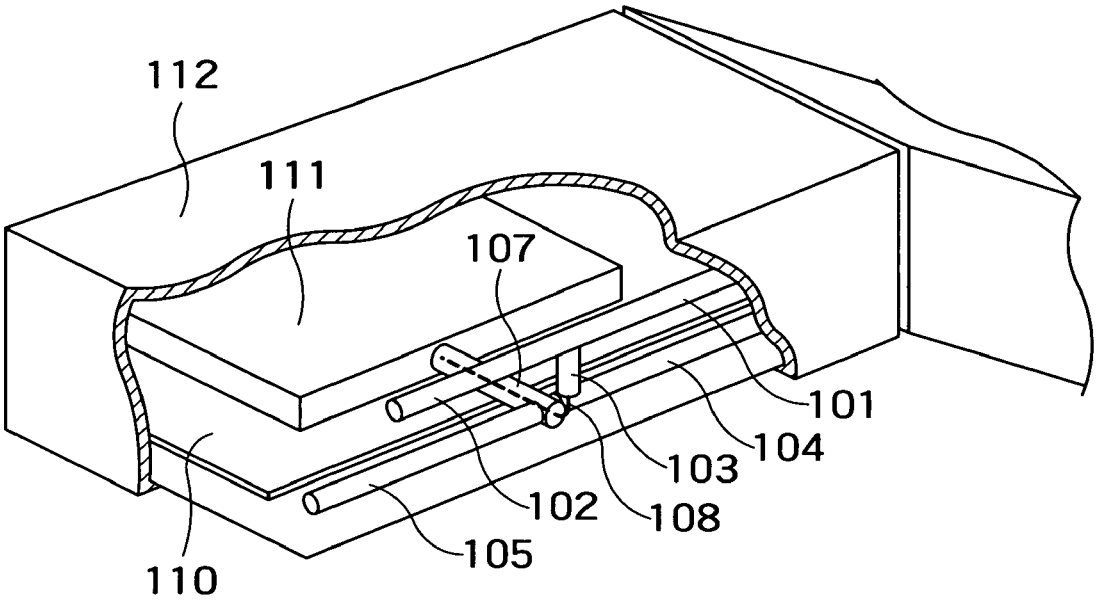
FIG. 10 is a figure showing an example of mounting of the radio communication apparatus shown in FIG. 9 to a mobile terminal.

FIG. 10 shows an example of mounting of the radio communication apparatus shown in FIG. 9 to a mobile terminal.

Reference numeral 112 denotes a housing of the mobile terminal, and the radio communication apparatus shown in FIG. 9 is incorporated in the housing 112.

Figure 11:
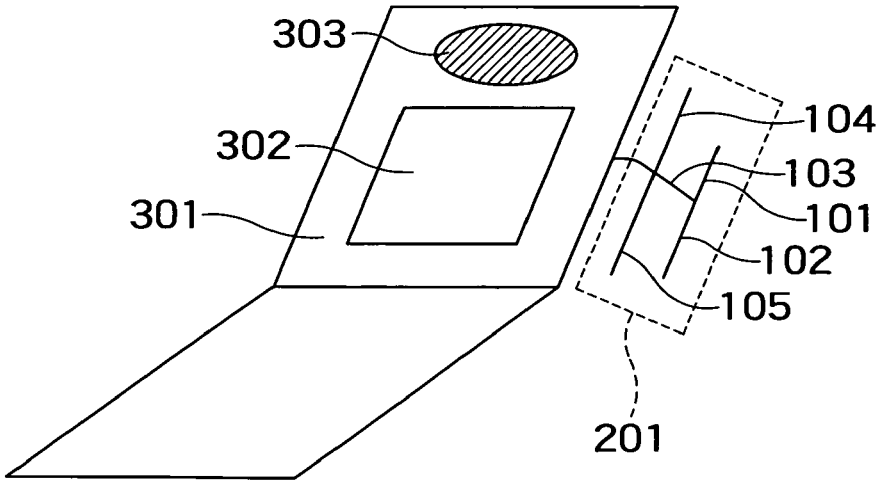
FIG. 11 is a figure explaining an installation position relative to a substrate of the antenna device.

FIG. 11 shows an example of installation position of the antenna device with respect to a substrate.

Reference numeral 301 denotes a substrate of the mobile terminal, 302 denotes a display section, and 303 denotes a loudspeaker. The display section 302 and the loudspeaker 303 are arranged on the substrate 301 of the mobile terminal.

When the antenna device 201 is mounted, the wire elements 104, 105 are provided in the same plane as the substrate 301, and the wire element 103 is provided so as to be perpendicular to the substrate 301. The wire elements 101, 102 are arranged to the side of the direction opposite to a human body. The sum of the lengths of the wire elements 104, 105 is set to, for example, 1.1 times the sum of the lengths of the wire elements 101, 102.

Figure 12:
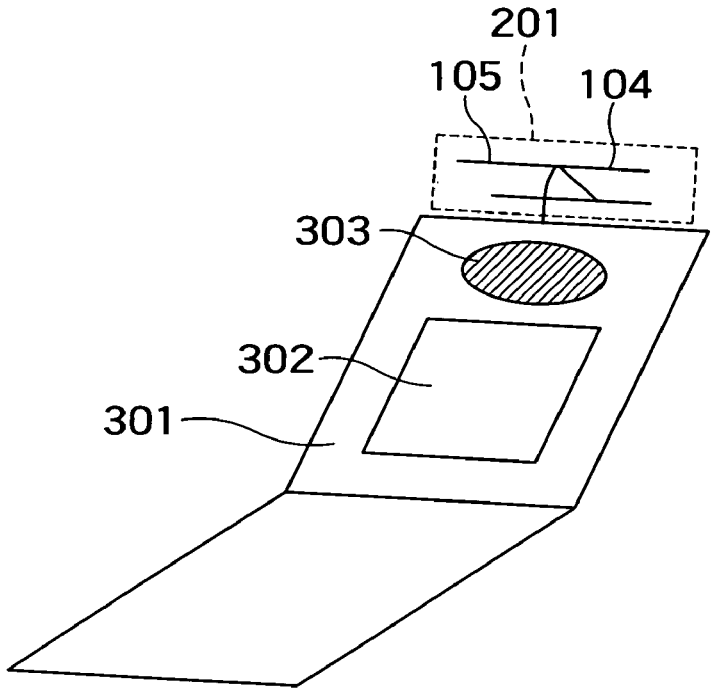
FIG. 12 is a figure explaining an installation position relative to the substrate of the antenna device.
Figure 13:
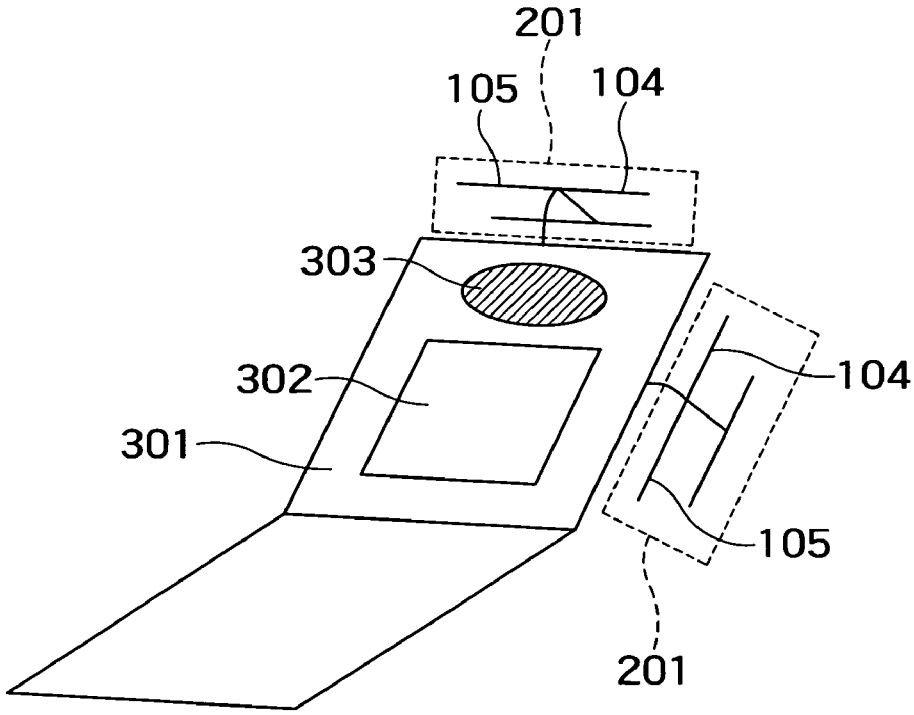
FIG. 13 is a figure showing an example in which two antenna devices are installed.

The installation position of antenna device 201 can be arbitrarily set with respect to the sides of the substrate, and may be the position shown in FIG. 12, other than the position shown in FIG. 11. Further, the number of the antenna devices 201 to be installed is not restricted to one, but as shown in FIG. 13, two antenna devices 201 may be installed.

Figure 14:
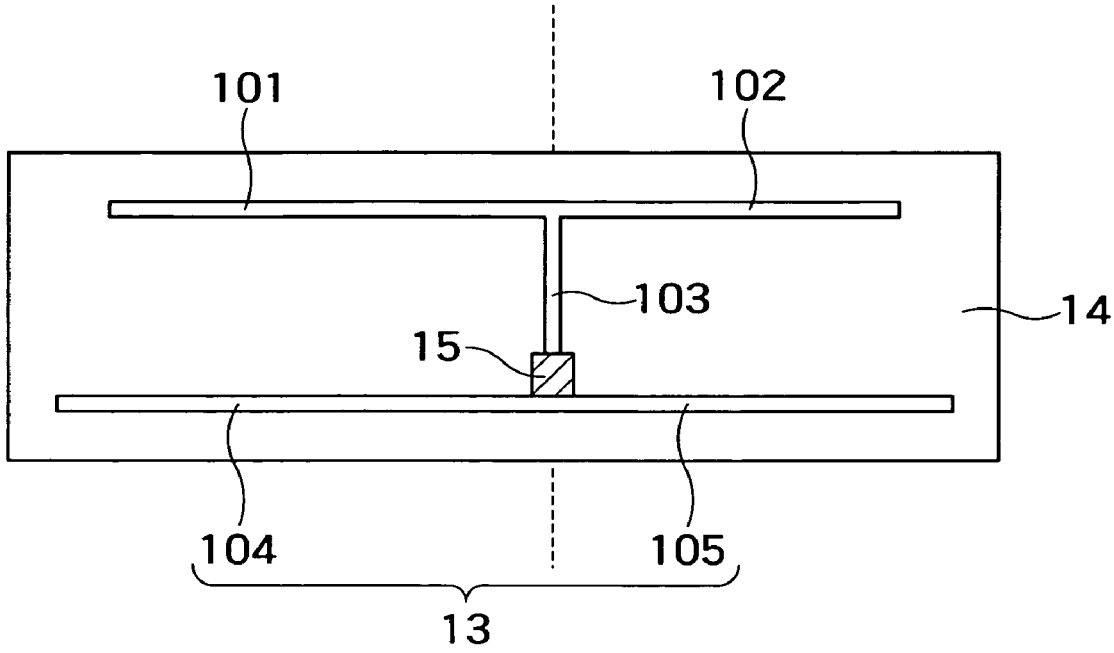
FIG. 14 is a figure showing an RFID (Radio Frequency IDentification) tag as an embodiment according to the present invention.
Figure 15:
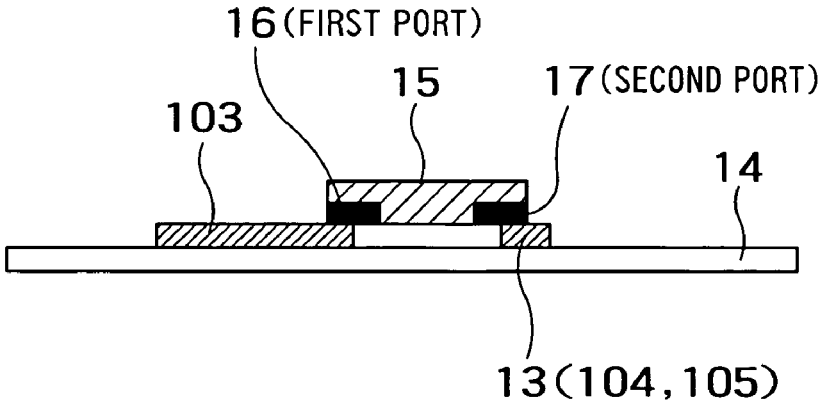
FIG. 15 is a sectional view taken along the dotted line in FIG. 14.

FIG. 14 is a figure showing an RFID (Radio Frequency IDentification) tag as an embodiment according to the present invention. FIG. 15 is a sectional view taken along the dotted line in FIG. 14.

In FIG. 14, the RFID tag is provided on film substrate 14. The RFID tag may be buried within the film substrate 14. The film substrate 14 is generally formed by using PET, polyimide and the like. The RFID tag is similar to the antenna device in shown in FIG. 1 except providing an IC chip 15 instead of the feed point 100. As shown in FIG. 15, the IC chip 15 is provided with a first port 16 and a second port 17. The first port 16 is connected to the wire element 103 by a conductive adhesive. The second port 17 is connected to a third wire antenna element 13 (wire elements 104, 105) by the conductive adhesive. The second port 17 is arranged to serve as the ground. The IC chip 15 generally includes a transmission/reception circuit which includes a detector/rectifier, a demodulator, a modulator, a signal processor and the like, and a tag storage which stores tag information (for example, detailed information of an article to which the RFID tag is attached). The transmission/reception circuit corresponds to, for example, a radio frequency circuit. The first port 16 and the second port 17 may be provided with the transmission/reception circuit. The transmission/reception circuit reads out, for example, the tag information from the tag storage, performs a transmission processing on the read tag information such as a modulation and up-conversion etc. to generate a radio frequency signal (a transmission signal). And the transmission/reception circuit supplies the generated radio frequency signal for the first and second ports 16, 17.

In FIG. 14, the length of the wire element 104 corresponds to one side of the third wire antenna element 13 seen from the second port 17. The length of the wire element 105 corresponds to the other side of the third wire antenna element 13 seen from the second port 17.

By sticking the film substrate 14 having the RFID tag perpendicular to the stick surface of an article, the desired unidirectional directivity can be obtained, while suppressing the performance degradation due to the influence of the article to which the RFID tag is stuck.

As described above, according to the present embodiment, it is designed so that the length of the first wire antenna element (101, 102) is set to about a half wavelength of the frequency of radio wave in use, and that the length of each wire element 101 to 105 is set to cause a parallel resonance mode, as a result of which a radio wave of a desired frequency can be transmitted or received.

Further, the length of the third wire antenna element (104, 105) is set to be longer than the length of the first wire antenna element (101, 102), so that a radiation pattern having desired unidirectional directivity can be obtained.

Further, the connection point of the first wire antenna element and the second wire antenna element is arranged to be offset from the center of the first wire antenna element in a range not smaller than (0.013×wavelength of the radio wave in use) and not larger than (0.03×wavelength of the radio wave in use), so that a suitable VSWR and gain can be obtained.

Further, the length of the third wire antenna element is designed to be a length not shorter than 1.1 times and not longer than 1.4 times the length of the first wire antenna element, so that a suitable VSWR and gain can be obtained.

Further, according to the present embodiment, it is possible to provide an antenna device which does not need a ground plane, and which has a low posture as compared with the conventional dipole antenna fitted with a reflector plate, so that the miniaturization of the antenna device itself can be effected. Further, the unidirectional directivity can be obtained, and thereby a high efficiency can be obtained in the vicinity of a human body. Further, the antenna device according to the present embodiment is an unbalanced power feeding type antenna device and needs neither a balun nor a matching circuit, so that the antenna device can be easily mounted to a small apparatus.

Further, the antenna device according to the present embodiment is not changed in performance even when it is in the vicinity of the ground plane, and thereby has a degree of freedom in installation position with respect to the ground plane.

The antenna device according to the present embodiment makes it possible to obtain a high efficiency when provided in the vicinity of a small and lossy medium such as a human body, so that the antenna device can be applied as an antenna device for use in a wearable apparatus or an RFID tag.

Further, the antenna device according to the present embodiment, is not changed in performance even when arranged in the vicinity of the ground plane, and thereby has a degree of freedom in installation position with respect to the ground plane, as a result of which the antenna device can be widely applied in general to small radio apparatuses.

What is claimed is:

1. An antenna device comprising:

a first wire antenna element having a length about half a wavelength of a radio wave in use;

a second wire antenna element which is in a same plane as the first wire antenna element and substantially perpendicular to the first wire antenna element, and which is connected to the first wire antenna element at one end;

a third wire antenna element which is in the same plane as the first wire antenna element and substantially in parallel with the first wire antenna element; and a feed point provided on the second wire antenna element, wherein the length of the third wire antenna element is longer than the length of the first wire antenna element, and wherein a sum (a+c+h) of a length (a) of one side of the first wire antenna element seen from a first connection point of the first wire antenna element and the second wire antenna element, a length (c) of the one side of the third wire antenna element seen from a second connection point of the second wire antenna element and the third wire antenna element, and a length (h) of the second wire antenna element, is different from a sum (b+d+h) of a length (b) of the other side of the first wire antenna element seen from the first connection point, a length (d) of the other side of the third wire antenna element seen from the second connection point, and the length (h) of the second wire antenna element, and the sum (a+c+h) and the sum (b+d+h) each are lengths effecting frequencies of two series resonances, the antenna device operating at a frequency of parallel resonance being used as the frequency of the radio wave in use, wherein the frequency of parallel resonance is between the frequencies of two series resonances, and the first connection point is offset from a center point of the first wire antenna element, the offset being larger than or equal to (0.013×the wavelength of the radio wave in use) and smaller than or equal to (0.03×the wavelength of the radio wave in use).

2. The antenna device according to claim 1, wherein the length of the third wire antenna element is longer than or equal to 1.1 times and shorter than or equal to 1.4 times the length of the first wire antenna element.

3. The antenna device according to claim 1, further comprising a feeder line configured to feed power to the feed point, wherein the third wire antenna element is connected to an outer conductor of the feeder line.

4. A mobile terminal comprising:

a definite ground plane;

a radio frequency module on the definite ground plane;

an antenna device in a vicinity of an end side of the definite ground plane, the antenna device including a first wire antenna element having a length about half a wavelength of a radio wave in use, a second wire antenna element which is in a same plane as the first wire antenna element and substantially perpendicular to the first wire antenna element, and which is connected to the first wire antenna element at one end, a third wire antenna element which is in the same plane as the first wire antenna element and substantially in parallel with the first wire antenna element, and a feed point provided on the second wire antenna element, wherein the length of the third wire antenna element is longer than the length of the first wire antenna element, and wherein a sum (a+c+h) of a length (a) of one side of the first wire antenna element seen from a first connection point of the first wire antenna element and the second wire antenna element, a length (c) of the one side of the third wire antenna element seen from a second connection point of the second wire antenna element and the third wire antenna element, and a length (h) of the second wire antenna element, is different from a sum (b+d+h) of a length (b) of the other side of the first wire antenna element seen from the first connection point, a length (d) of the other side of the third wire antenna element seen from the second connection point, and the length (h) of the second wire antenna element, the sum (a+c+h) and the sum (b+d+h) each are lengths effecting frequencies of two series resonances the antenna device operating at a frequency of parallel resonance being used as the frequency of the radio wave in use, wherein the frequency of parallel resonance is between the frequencies of two series resonances, and the first connection point is offset from a center point of the first wire antenna element, the offset being larger than or equal to (0.013×the wavelength of the radio wave in use) and smaller than or equal to (0.03×the wavelength of the radio wave in use); and a feeder line configured to feed power from the radio frequency module to the feed point of the antenna device, wherein the definite ground plane is substantially perpendicular to a plane in which the first, second, and third wire antenna elements exist.

5. The mobile terminal according to claim 4, wherein the length of the third wire antenna element is longer than or equal to 1.1 times and shorter than or equal to 1.4 times the length of the first wire antenna element.

6. An RFID tag comprising:

a first wire antenna element having a length about half a wavelength of a radio wave in use;

a second wire antenna element which is in a same plane as the first wire antenna element and substantially perpendicular to the first wire antenna element, and which is connected to the first wire antenna element at one end;

a third wire antenna element which is in the same plane as the first wire antenna element and substantially in parallel with the first wire antenna element; and an IC chip including a first port connected to the second wire antenna element, a second port connected to the third wire antenna element, a tag storage storing tag information, and a radio frequency circuit which performs a transmission processing for the tag information to generate a transmission signal with a wavelength about half the wavelength of the radio wave in use and supplies the generated transmission signal for the first and second ports, wherein the length of the third wire antenna element is longer than the length of the first wire antenna element, and wherein a sum (a+c+h) of a length (a) of one side of the first wire antenna element seen from a connection point of the first wire antenna element and the second wire antenna element, a length (c) of the one side of the third wire antenna element seen from the second port, and a length (h) of the second wire antenna element, is different from a sum (b+d+h) of a length (b) of the other side of the first wire antenna element seen from the connection point, a length (d) of the other side of the third wire antenna element seen from the second port, and the length (h) of the second wire antenna element, and the sum (a+c+h) and the sum (b+d+h) each are lengths effecting frequencies of two series resonances, the antenna device operating at a frequency of parallel resonance being used as the frequency of the radio wave in use, wherein the frequency of parallel resonance is between the frequencies of two series resonances, and wherein the first connection point is offset from a center point of the first wire antenna element, the offset being larger than or equal to (0.013×the wavelength of the radio wave in use) and smaller than or equal to (0.03×the wavelength of the radio wave in use).

7. The RFID tag according to claim 6, wherein the length of the third wire antenna element is longer than or equal to 1.1 times and shorter than or equal to 1.4 times the length of the first wire antenna element.

* * * * *